US009178272B2

(12) United States Patent
Chakam et al.

(10) Patent No.: US 9,178,272 B2
(45) Date of Patent: Nov. 3, 2015

(54) HIGHLY INTEGRATED MULTIBAND SHARK FIN ANTENNA FOR A VEHICLE

(75) Inventors: Guy-Aymar Chakam, Regensburg (DE); Martin Schürmeier, Regensburg (DE); Florian Butscher, Aschau im Chiemgau (DE); Frank Mierke, München (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 521 days.

(21) Appl. No.: 13/505,552

(22) PCT Filed: Oct. 29, 2010

(86) PCT No.: PCT/EP2010/066479
§ 371 (c)(1),
(2), (4) Date: Jul. 17, 2012

(87) PCT Pub. No.: WO2011/051454
PCT Pub. Date: May 5, 2011

(65) Prior Publication Data

US 2012/0274519 A1 Nov. 1, 2012

(30) Foreign Application Priority Data

Nov. 2, 2009 (DE) ..... 10 2009 051 605

(51) Int. Cl.
*H01Q 1/24* (2006.01)
*H01Q 1/32* (2006.01)
(Continued)

(52) U.S. Cl.
CPC ..... *H01Q 1/3275* (2013.01); *H01Q 1/526* (2013.01); *H01Q 9/0407* (2013.01)

(58) Field of Classification Search
USPC ..... 343/725, 700 MS, 844
See application file for complete search history.

(56) References Cited

U.S. PATENT DOCUMENTS 6,329,954 B1 12/2001 Fuchs et al. ..... 343/725
6,522,291 B1 2/2003 Noguchi et al. ..... 342/357.64
(Continued)

FOREIGN PATENT DOCUMENTS

CN 1893177 A 1/2007 ..... H01Q 1/32
DE 20210312 U1 9/2002 ..... H01Q 1/32
(Continued)

OTHER PUBLICATIONS

German Office Action for Application No. 10 2009 051 605.0-55 (3 pages), May 5, 2010.
(Continued)

*Primary Examiner* — Sue A Purvis
*Assistant Examiner* — Jae Kim
(74) *Attorney, Agent, or Firm* — Slayden Grubert Beard PLLC

(57) ABSTRACT

A multiband shark fin antenna for a vehicle may include at least one transmitting and one receiving antenna element from the group consisting of AM/FM antennas, telephone and RKE antennas, GPS antenna, SDARS antenna, stacked patch antenna, DAP antenna, WLAN antenna, WIMAX antenna or DRM antenna. The antenna elements are disposed beneath a joint shark fin-shaped outer cover on the exterior of the vehicle. On the inside, the shark fin-shaped outer cover includes an antenna circuit board having the antenna elements disposed thereon. Electronic adjustment or amplifier circuits including a transceiver, tuner or receiver are disposed on both the upper and lower faces of the antenna circuit board. Shielding plates, which shield the adjustment or amplifier circuits with respect to the antenna elements, are disposed on the upper side of the antenna circuit board.

12 Claims, 3 Drawing Sheets

(51) Int. Cl.
*H01Q 1/52* (2006.01)
*H01Q 9/04* (2006.01)

(56) References Cited

U.S. PATENT DOCUMENTS

| | | | | |
|---|---|---|---|---|
| 6,617,961 | B1 * | 9/2003 | Janssen et al. | 340/5.8 |
| 6,888,503 | B2 | 5/2005 | Shikata | 343/700 MS |
| 7,034,758 | B2 | 4/2006 | Haidacher et al. | 343/725 |
| 7,109,925 | B2 | 9/2006 | Noro et al. | 343/700 MS |
| 7,333,065 | B2 | 2/2008 | Lindackers et al. | 343/713 |
| 7,633,452 | B2 | 12/2009 | Noro et al. | 343/713 |
| 2002/0008666 | A1 * | 1/2002 | Kushihi et al. | 343/702 |
| 2003/0122722 | A1 * | 7/2003 | Sugiyama et al. | 343/767 |
| 2004/0252064 | A1 * | 12/2004 | Yuanzhu | 343/702 |
| 2004/0263399 | A1 * | 12/2004 | Lin et al. | 343/702 |
| 2005/0003685 | A1 * | 1/2005 | Abe et al. | 439/76.1 |
| 2006/0290580 | A1 | 12/2006 | Noro et al. | 343/715 |
| 2010/0315305 | A1 * | 12/2010 | Takisawa et al. | 343/824 |

FOREIGN PATENT DOCUMENTS

| | | | | |
|---|---|---|---|---|
| DE | 10133295 | A1 | 1/2003 | H01Q 1/32 |
| DE | 202004004740 | U1 | 9/2004 | H01Q 1/12 |
| DE | 202004004740 | * | 10/2004 | 343/702 |
| DE | 102005048843 | A1 | 4/2007 | B62D 25/00 |
| DE | 202009003448 | U1 | 5/2009 | H01Q 1/12 |
| DE | 102007055234 | A1 | 6/2009 | H01Q 1/36 |
| DE | 102009051605 | A1 | 5/2011 | H01Q 1/12 |
| EP | 1286414 | A1 | 2/2003 | H01Q 1/12 |
| EP | 1394899 | A2 | 3/2004 | H01Q 1/12 |
| JP | 2001332919 | A | 11/2001 | G01S 19/36 |
| JP | 2001332920 | A | 11/2001 | H01Q 1/32 |
| WO | 2011/051454 | A1 | 5/2011 | H01Q 1/32 |

OTHER PUBLICATIONS

International Search Report and Written Opinion for Application No. PCT/EP2010/066479 (14 pages), Mar. 21, 2011.

Chinese Office Action, Application No. 201080060128.7, 12 pages, Dec. 13, 2013.

* cited by examiner

HIGHLY INTEGRATED MULTIBAND SHARK FIN ANTENNA FOR A VEHICLE

CROSS-REFERENCE TO RELATED APPLICATIONS

This application is a U.S. National Stage Application of International Application No. PCT/EP2010/066479 filed Oct. 29, 2010, which designates the United States of America, and claims priority to German Application No. 10 2009 051 605.0 filed Nov. 2, 2009, the contents of which are hereby incorporated by reference in their entirety.

TECHNICAL FIELD

This disclosure relates to a multiband shark fin antenna for a vehicle. To this end, the antenna module has antenna elements. The antenna elements can be arranged under a common shark-fin-shaped outer cover on the outside of the vehicle. The shark-fin-shaped outer cover has in its interior an antenna circuit board on which the antenna elements are arranged.

BACKGROUND

From printed documents DE 101 33 295 A1, DE 20 2004 004 740.3, DE 202 10 312 U1, U.S. Pat. No. 7,034,758, U.S. Pat. No. 6,329,954 and U.S. Pat. No. 7,333,065, multiband antennas and multiband antenna devices for vehicles for external assembly on the chassis are known. These multiband antennas include an external shark-fin-shaped cap, a protective cap for stabilizing the antenna elements mechanically, the various antenna elements, a circuit board, one or at most two amplifier or filter circuits and a chassis. The characteristic feature of this multiband antenna is the fact that the antenna elements are on the top of the circuit board fixed to the chassis within the cap. On this side, on which the antennas are located, no electronic circuits can be found (amplifiers, filters) in order to avoid any disturbances and couplings. For this reason, in the previous antennas all the electronics are located on the bottom of the circuit board which is correspondingly shielded by the chassis. If the complexity of such a multiband antenna is to be increased without changing the outside dimensions of the multiband antenna significantly, new approaches must be found.

Thus, a highly integrated multiband shark fin antenna has previously been lacking which combines as comprehensively as possible antenna elements for radio services, vehicle access systems, communication services, navigation services and/or also TV services and their corresponding tuners, front ends, amplifiers, receivers, transceivers and a suitable data connection (LIN, CAN, USB, LVDS and others) instead of only coaxial cables in one unit.

SUMMARY

In one embodiment, a multiband shark fin antenna having at least one transmitting and one receiving antenna element is provided, wherein the transmitting and receiving antenna elements are arranged under a common shark-fin-shaped outer cover, wherein the shark-fin-shaped outer cover also has in its interior: an antenna circuit board on which the transmitting and receiving antenna elements are arranged, electronic matching or amplifier circuits with transceivers, tuners or receivers which are arranged on the top and underside of the antenna circuit board, and shielding plates which shield the matching or amplifier circuits with transceivers, tuners or receivers from the transmitting and receiving antenna elements on the top of the circuit board, wherein the shielding plates are arranged on the top of the antenna circuit board.

In a further embodiment, at least one transmitting and one receiving antenna element from the group of the following antenna elements: AM/FM antennas, telephone and RKE antenna, GPS antenna, SDARS antenna, stacked patch antenna, DAB antenna, WLAN antenna, WIMAX antenna, and DRM antennas. In a further embodiment, the antenna circuit board having the transmitting and receiving antenna element and the electronic circuits are arranged on a bottom part of an antenna housing. In a further embodiment, a protective cover, sheathing the antenna elements, of the antenna housing is arranged between the antenna elements and the shark-fin-shaped outer cover. In a further embodiment, the bottom part engages with openings in the outer surface of the vehicle. In a further embodiment, the protective cover engages with the bottom part via snap-action hooks and snap-action lugs. In a further embodiment, the equipped antenna circuit board is supported by the bottom part and covered by the protective cover. In a further embodiment, the protective cover has a pivoting axis to which the shark-fin-shaped outer cover is pivotably attached. In a further embodiment, plug-in connectors protrude out of the bottom part and into the vehicle and are connected to communication devices of the vehicle via feed lines of a cable tree. In a further embodiment, the telephone and RKE antenna has a plate protruding into the shark-fin-shaped outer cover, which stands vertically on the antenna circuit board and has in its foot area a recess in which a GPS antenna is arranged as patch antenna. In a further embodiment, a GPS patch antenna is arranged on a shielding plate which encloses an amplifier and/or an antenna matching circuit. In a further embodiment, an SDARS antenna is arranged as patch antenna spaced apart from the GPS patch antenna on a shielding plate on the antenna circuit board, the shielding plate enclosing an amplifier and/or an antenna matching circuit. In a further embodiment, amplifier and antenna matching circuits are arranged with the transmitting and receiving antenna element on a top of the antenna circuit board sheathed by shielding plates, and wherein transceivers, tuners or receivers are arranged on a rear of the antenna circuit board.

BRIEF DESCRIPTION OF THE DRAWINGS

Example embodiments will be explained in more detail below with reference to figures, in which.

DETAILED DESCRIPTION

Figure 1:
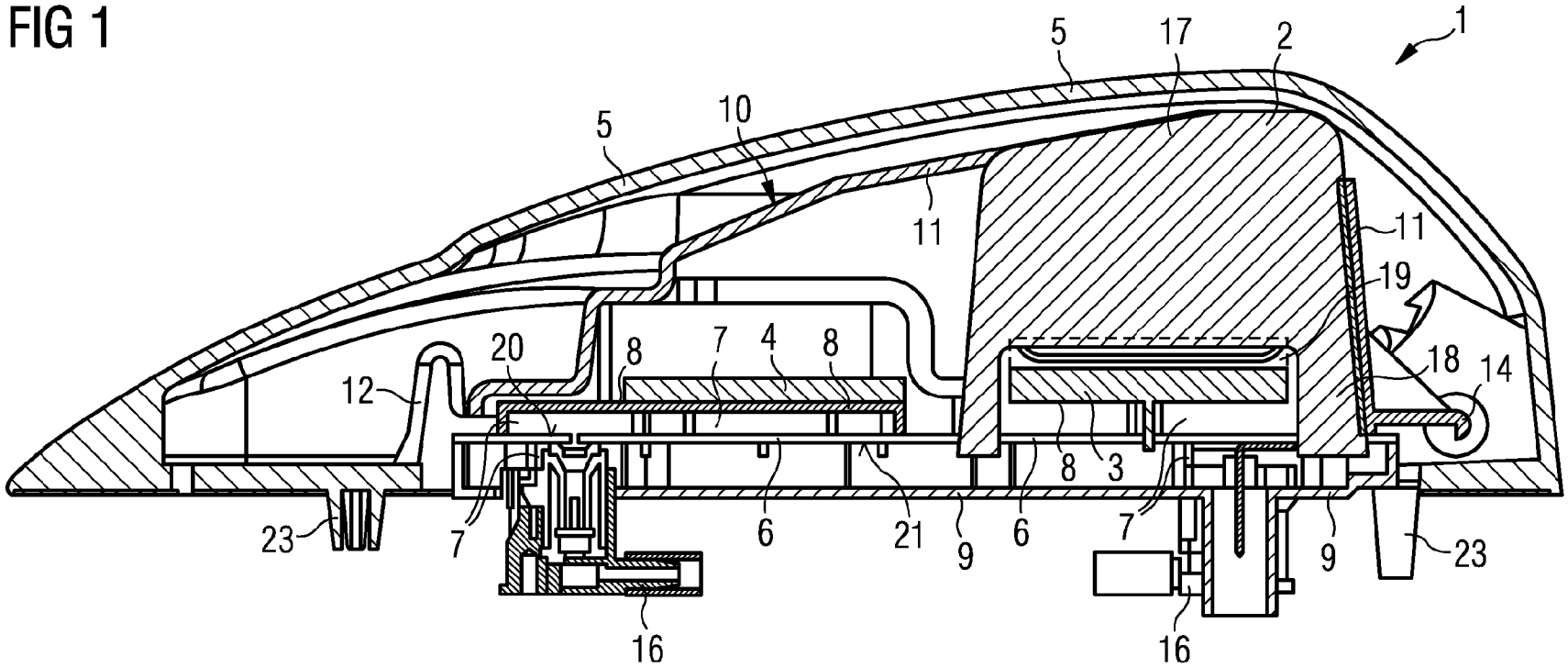
FIG. 1 shows a diagrammatic cross section through a multiband shark fin antenna according to an example embodiment.

Some embodiments provide highly integrated multiband shark fin antennas which combine both receiving and transmitting antennas and their tuners, front ends, amplifiers, receivers, transceivers and a suitable data connection in one shark-fin-shaped housing. Furthermore, a plurality of antenna elements and electronic circuits is to be accommodated in a very small area and an antenna housing is to be provided which can be assembled on an outer surface of a vehicle by simple means and is easily accessible in the case of interference.

According to one embodiment, a highly integrated multiband shark fin antenna is created for a vehicle. To this end, the multiband shark fin antenna has at least one transmitting and one receiving antenna element. The transmitting and receiving antenna elements are arranged under a common shark-fin-shaped outer cover. The shark-fin-shaped outer cover has in its interior an antenna circuit board which is fixed on a chassis. On the top of this circuit board, there are both the transmitting and receiving antenna elements and also electronic matching or amplifier circuits, transceivers (parts or complete), tuners, front ends or receivers. These electronic circuits are placed optimized locally on the circuit board and grouped depending on service or depending on antenna position and are insulated electrically with the aid of shielding plates in each case in such a manner that they do not cause any interference. Thus, a number of shielding plates are located on the top of the circuit board. Further parts of the electronics are located on the bottom of the circuit board and are insulated electrically and shielded correspondingly by the chassis as previously.

Above the shielding plates, antennas or antenna elements, respectively, for the different services can be placed. For example, patch antennas or stacked patch antennas for satellite services can be placed coupled directly or only capacitively above shielding plates. Patch antennas are antennas constructed to be planar, as are used especially in the gigahertz frequency band. The radiating element of a patch antenna is called patch. Monopole-like antennas for telephone, DAB, WLAN, etc. can be positioned above shielding plates. Corresponding recesses or structuring of the shielding plate can be provided.

The geometric shape, the structure and the dimensions of an individual shielding plate depends on the overall size and the geometry of the antennas, the desired directional pattern of the antenna, the tuner, receiver, amplifier, transceiver to be shielded, and on the position of the shielding plate relative to all other antennas. A corresponding activity may thus be necessary in order to determine an optimal design of the shielding plate in order to achieve at least the same performance similar to the case without shielding plate. For example, a direct and fast return feed of the current to ground is provided for a shielding plate which is below a patch antenna for GPS or SDARS and shields the corresponding amplifier. For this reason, a corresponding ground pin is provided in the shielding plate structure directly in the vicinity of the feed point of the patch, independently of the type of coupling (direct or capacitive) of the shielding plate to the patch. In order to avoid any feedbacks between amplifier and antenna, this ground pin, together with the feed pin of the patch, is provided as an electromagnetically closed structure. These measures are taken into consideration in the structure of a shielding plate.

By means of this multiband shark fin antenna for a vehicle, the number of services which are arranged in a shark fin antenna is increased by a multiple compared with certain conventional antennas due to the gain in space now possible. In addition, tuner, receiver and transceiver and a corresponding data connection (LIN, CAN, USB, Ethernet, inter alia) are integrated in the shark fin antenna without the size of the shark fin antenna being changed. Thus, an increase in the degree of integration and an introduction of the digital data connection option may now be achieved within the same size compared with current shark fin antennas even though more services and more electronics are integrated in the shark fin antenna.

Furthermore, a narrow, compact placement of the matching and amplifier circuits and of the tuners, receivers and amplifiers jointly with the antennas on the antenna circuit board may be achieved. In addition, problems of cross coupling between the antenna elements and the matching and amplifier circuits and the tuners, receivers and transceivers may be solved by means of the multiband shark fin antenna by embodiments disclosed herein while simultaneously safeguarding the requirements of the directional pattern for the antenna elements.

In one embodiment, the shark fin antenna has at least one transmitting and one receiving antenna element from the group of the following antenna elements:

AM/FM antenna,
telephone and RKE antenna (2),
GPS antenna (3),
SDARS antenna (4),
stacked patch antenna,
DAB antenna,
WLAN antenna,
WIMAX antenna, and
DRM antenna.

For in-vehicle services such as RKE (remote keyless entry) and/or TPMS (tire pressure monitoring system) and/or a PASE system (passive start entry), the multiband shark fin antenna can have correspondingly compact antenna elements. For this purpose, it will be possible to handle, e.g., monopole-like antennas and/or F antenna elements inverted in planar mode in the multiband shark fin antenna.

A telephone antenna element which, at the same time, can also serve as RKE (remote keyless entry) or WLAN antenna element may be provided. In this embodiment, however, it can also be disposed on the circuit board standing vertically. Furthermore, other antennas can be implemented for RKE and WLAN.

The dimensioning of the multiband shark fin antenna is dependent on the services and their number. This means usually the more antenna elements are to be accommodated on an elongated circuit board in the shark fin antenna, the greater will be the ratio of length to width of the shark fin to be provided on the outside of the vehicle. The length of such a shark fin antenna can extend over some 10 mm. Smaller antenna modules having a lesser degree of integration can be accommodated already in shark fins of less than 50 mm.

The multiband shark fin antenna may have antenna elements for at least three of the following groups of services: AM, DRM, FM; DAB-S, DAB T; DVB-T, DVB-H, DVB-S; GSM850 (AMPS), GSM900; GSM1800, GSM1900, UMTS; road toll, toll service, WLAN, Bluetooth; GPS, SDARS, UWB, RKE, Long Range, TPMS, PASE; vehicle-to-vehicle, vehicle-to-infrastructure, automatic cruise control (ACC).

In a further embodiment, it is also provided to provide for the terrestrial digital audio radio service (DAB-T) and the satellite-supported digital audio radio service (DAB-S) only one antenna receiving module in the multiband shark fin antenna, this antenna receiving module having a single feed point which is provided both for the resonant-frequency band III having the resonant frequencies $f_{III}$ between 174 MHz$\leq f_{III} \leq$240 MHz and in a further resonant-frequency band L having the resonant frequencies $f_L$ between 1452 MHz$\leq f_L \leq$1492 MHz. In this context, the satellite-supported digital audio radio service (DAB-S) belongs to the upper frequency range of the resonant-frequency band L.

In a lower resonant-frequency band, one radio antenna element serves the frequency band GSM850 having resonant frequencies $f_{850}$ between 824 MHz≤$f_{850}$≤894 MHz and the frequency band GSM900 having resonant frequencies $f_{900}$ between 890 MHz≤$f_{900}$≤960 MHz and the resonant frequencies of the frequency band GSM1800 having resonant frequencies $f_{1.8}$ between 1.71 GHz≤$f_{1.8}$≤1.88 GHz and the frequency band GSM1900 having resonant frequencies $f_{1.9}$ between 1.85 GHz≤$f_{1.9}$≤1.99 GHz and the frequency band UMTS having frequencies $f_{2.0}$ between 1.92 GHz≤$f_{2.0}$≤2.17 GHz.

The abovementioned GPS patch antenna receives in the frequency band $f_{GPS}$ between 1.574 GHz≤$f_{GPS}$≤1.577 GHz whilst the SDARS patch antenna receives in the frequency band $f_{SDARS}$ between 2.320 GHz≤$f_{SDARS}$≤2.345 GHz. The further frequencies $f_W$ for WLAN and Bluetooth services are located between 2.4 GHz≤$f_W$≤2.485 GHz. The resonant frequencies $f_I$ for the infrastructure services are located distinctly above that in the range between 5.87 GHz≤$f_I$≤5.925 GHz.

In one embodiment, the antenna circuit board having the at least one transmitting and receiving antenna element and the electronic circuits are arranged on a bottom part of an antenna housing. This bottom part is dimensioned in such a manner that it can be arranged as an independent component under a shark-fin-shaped outer cover and can be arranged in corresponding openings in the outside of the vehicle by means of a plug-in connector protruding out of the bottom part in the direction of the vehicle interior. In a further embodiment, a protective cover, sheathing the antenna elements, of the antenna housing is arranged between the antenna elements and the shark-fin-shaped outer cover.

Together with the bottom part, this protective cover forms an inner antenna housing of plastic which can be metalized in part-areas in order to enhance the directional characteristic of the antenna elements. In addition, this protective cover protects against mechanical damage to the antenna elements and the circuits. The protective cover has snap-action lugs which can engage with snap-action hooks of the bottom part so that a compact antenna housing is produced which can be produced separately from the shark-fin-shaped outer cover. During a final assembly, it is only necessary to put the shark-fin-shaped outer cover over the antenna housing and fit it into corresponding prepared fitting openings on the outside of the vehicle with corresponding locating pins and fix it.

Furthermore, the bottom part has snap-action hooks which engage with the outer cover when the shark-fin-shaped outer cover is placed on. In addition, the protective cover has a pivoting axis to which the shark-fin-shaped outer cover can be pivotably attached. The equipped antenna circuit board is clamped between the protective cover and the bottom part and is supported by the bottom part and covered by the protective cover.

In a further embodiment, the telephone and RKE antenna has a plate protruding into the shark-fin-shaped outer cover, which stands vertically and aligned in the longitudinal direction on the antenna circuit board and forms in its foot area a recess in which a GPS antenna is arranged as patch antenna. For this purpose, a GPS patch antenna is arranged on a shielding plate which encloses an amplifier and/or an antenna matching circuit and thus protects these circuits against an effect from the antenna element arranged above it. The shielding plate which encloses the amplifier and/or antenna matching circuits ensures also that the EMC (electromagnetic compatibility) is improved.

Instead of the abovementioned stacking of a GPS patch antenna on an SDARS antenna, an SDARS antenna can also be arranged spaced apart from the GPS patch antenna on a further shielding plate on the antenna circuit board, the shielding plate enclosing an amplifier and/or an antenna matching circuit. This shielding plate, too, acts—like already the shielding plate below the GPS patch antenna—and improves the EMC characteristics of the antenna module.

In a further embodiment, the rear of the circuit board is also utilized in that only amplifier and matching circuits are arranged on the top of the circuit board together with the antenna elements, and transceivers, tuners and/or receivers are placed on the rear of the antenna circuit board.

FIG. 1 shows a diagrammatic cross section through a multiband shark fin antenna 1 according to an example embodiment. In this embodiment, three antenna elements are arranged underneath a shark-fin-shaped outer cover 5. A first element for a telephone and RKE antenna 2 has an electrically conductive plate 17 which is arranged vertically in the longitudinal direction of the shark fin on a circuit board 6 and has in its foot area 18 a recess 19 in which a GPS antenna 3 is arranged which is directly connected to a shielding plate 8, the shielding plate 8 sheathing matching and amplifying circuits which are also arranged on the circuit board 6.

Spaced apart from the GPS antenna 3, an SDARS antenna 4 is arranged on a further shielding plate 8 in the front area of the multiband shark fin antenna, the shielding plate 8 being subdivided several times and protecting different circuits against coupling-in and crosstalk by the antenna elements. In addition, the sheathing shielding plates 8 improve the EMC characteristics of the multiband shark fin antenna 1.

Between the shark-fin-shaped outer cover 5 of the multiband shark fin antenna, a further protective cover 11 of an inner antenna housing 10 is arranged between the antenna elements on the circuit board 6 and the shark-fin-shaped outer cover 5. This protective cover 11, together with a bottom part 9 which supports and accommodates the circuit board 6, forms an inner antenna housing 10 which, completely with plug-in connectors 16 which protrude downward from the bottom part 9, can be produced, stored and assembled independently of the shark-fin-shaped cover 5.

When the shark-fin-shaped outer cover 5 is put over this inner antenna housing 10, the snap-action hooks 12 which are arranged at the protective cover 11 lock in and connect, additionally with a pivoting device 14 at the other ends of the protective cover 11, the shark-fin-shaped outer cover 5 to the inner antenna housing 10. At the same time or successively, the shark-fin-shaped outer cover 5 can then lock into corresponding locating openings in an outside of the vehicle in a final assembly with their locating pins 23 arranged on the bottom.

Figure 2A:
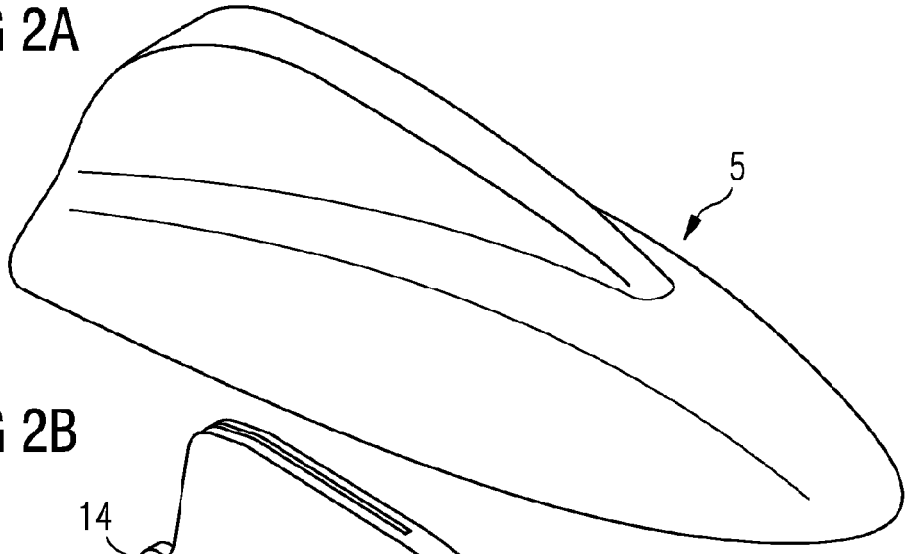
FIGS. 2A-2E show a diagrammatic pulled-apart perspective view of the multiband shark fin antenna according to FIG. 1.
Figure 2B:
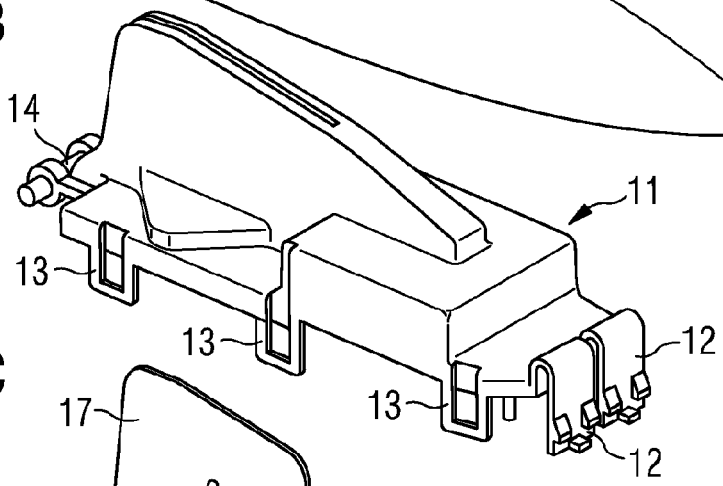
Figure 2C:
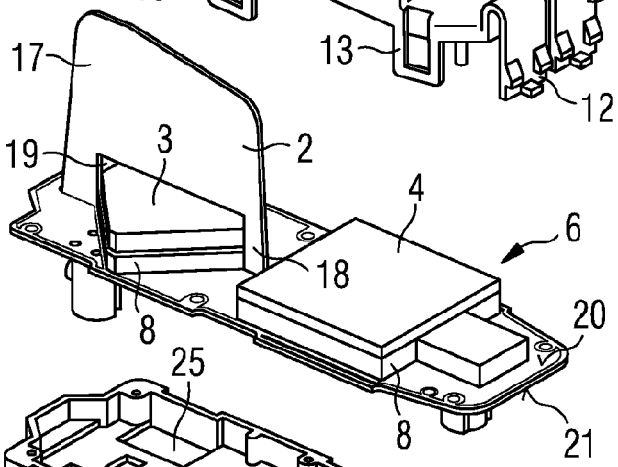
Figure 2D:
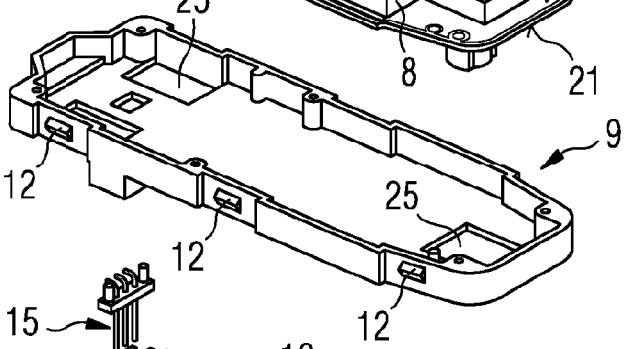

FIG. 2 shows with FIGS. 2A to 2E a diagrammatic pulled-apart perspective view of the multiband shark fin antenna 1 according to FIG. 1. To this end, FIG. 2A shows a diagrammatic perspective view of the shark-fin-shaped outer cover 5 which is put over an inner antenna housing 10 of the multiband shark fin antenna 1. The inner antenna housing 10 is composed of three components, namely a protective cover 11 shown in FIG. 2B, a circuit board 6 equipped with antenna elements 2 to 4, which is shown in FIG. 2C, and a bottom part 9 according to FIG. 2D.

The protective cover 11 shown in FIG. 2B has on a front end face two snap-action hooks 12 into which the shark-fin-shaped outer cover 5 shown in FIG. 2A can lock. In addition, the protective cover 11 has on the side opposite to the snap-action hooks 12 a pivoting axis 14 which can be engaged by the shark-fin-shaped outer cover 5 shown in FIG. 2A and around which the shark-fin-shaped outer cover 5 can be pivoted in order to engage the snap-action hook 12. In addition, the protective cover 11 shown in FIG. 2B has a number of snap-action lugs 13 which can engage corresponding snap-action hooks 12 of the bottom part 9 shown in FIG. 2D in order to form an inner antenna housing 10 as is shown in FIG. 1.

When the protective cover 11 and the bottom part 9 are brought together, the antenna circuit board 6 shown in FIG. 2C is clamped in. To this end, the equipped antenna circuit board 6 has on its top 20 the three antenna elements 2, 3 and 4, also shown in FIG. 1, a GPS antenna 3 being arranged on a shielding base of a shielding plate 8 in a recess 19 in the foot area 18 of a telephone and RKE antenna 2. Spaced apart from this construction, an SDARS antenna 4 is positioned on a further base of shielding plate 8.

The shielding plates 8 sheath matching and amplifying circuits arranged on the top 20 of the circuit board 6 and also transceivers, receivers and/or tuners. In this arrangement, the shielding plates protect against crosstalk and, at the same time, improve the EMC characteristics of the multiband shark fin antenna.

Figure 2E:
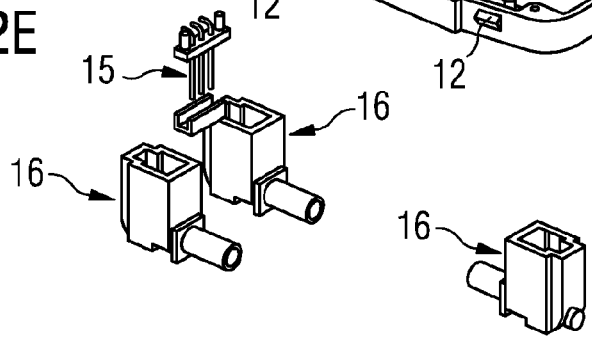

FIG. 2E shows diagrammatic perspective views of plug-in connectors 15 and 16 which can be introduced from below into corresponding recesses 25 of the bottom part 9 and can be placed onto corresponding plug contacts 22 which are arranged on the rear 21 of the antenna circuit board 6.

Figure 3:
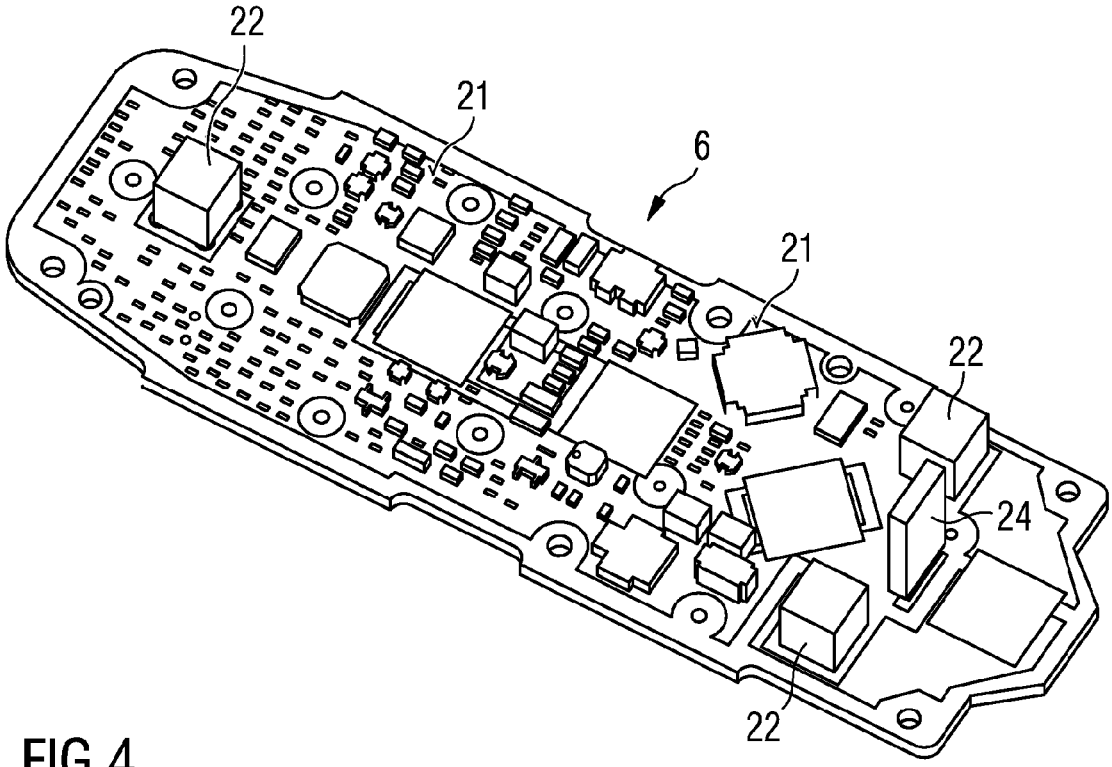
FIG. 3 shows a diagrammatic perspective view of a rear of an example antenna circuit board, according to an example embodiment.

FIG. 3 shows a diagrammatic perspective view of a rear 21 of an antenna circuit board 6. On the rear 21, a number of integrated circuits are arranged which can represent receivers, tuners and/or transceivers. In addition, plug contacts 22 and 24 can be seen which protrude through the recesses 25, shown in FIG. 2D, of the bottom part 9 so that the plug-in connectors 15 and 16 shown in FIG. 2E can be plugged onto these plug contacts from the underside of the bottom part 9.

Figure 4:
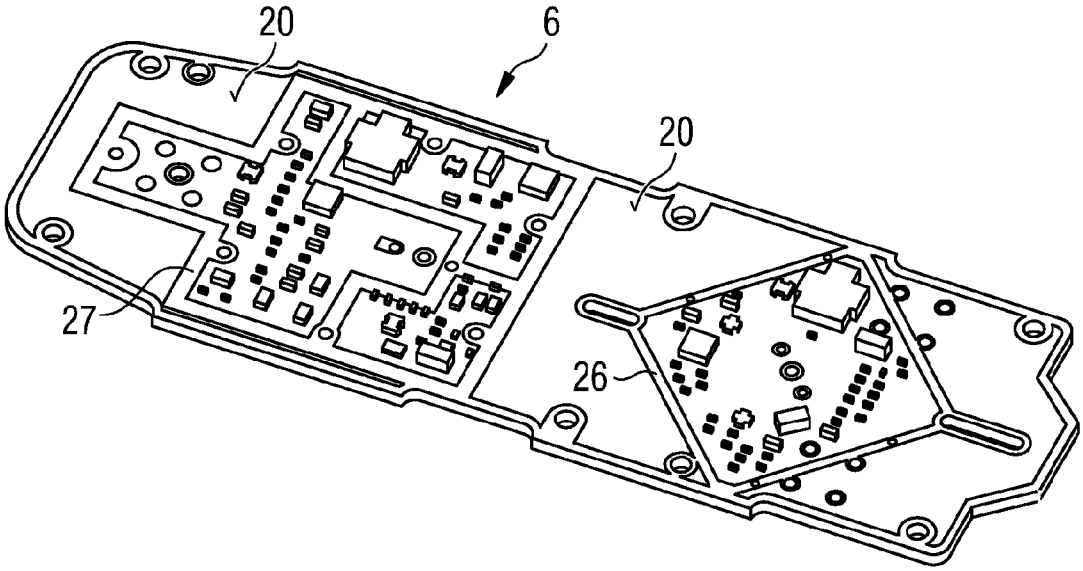
FIG. 4 shows diagrammatically a perspective view of a top of the example antenna circuit board without antenna elements and shielding plates.

FIG. 4 shows a diagrammatic perspective view of a top 20 of the antenna circuit board 6 without antenna elements and without shielding plates. However, the contours 26 and 27 of the box-shaped shielding plates shown in FIGS. 1 and 2C can be seen clearly in FIG. 4, the contour of partitions also being recognizable, especially in the case of the contour 27 of a shielding plate for the SDARS antenna.

The contours are copper conductor tracks on the top 20 of the circuit board 6 onto which the shielding plates can be screwed or soldered and are then connected to a ground contact. Furthermore, further matching and amplifying circuits can be seen in FIG. 4 which interact with the antenna elements not yet assembled here.

A multiband shark fin antenna (1) for a vehicle is disclosed. To this end, the multiband shark fin antenna (1) has at least one transmitting and one receiving antenna element (2, 3, 4) from the group of AM/FM antennas, telephone and RKE antennas (2), GPS antenna (3), SDARS antenna (4), stacked patch antenna, DAB antenna, WLAN antenna, WIMAX antenna or DRM antenna. The antenna elements (2, 3, 4) can be arranged under a common shark-fin-shaped outer cover (5) on the outside of the vehicle. The shark-fin-shaped outer cover (5) has in its interior an antenna circuit board (6) on which the antenna elements (2, 3, 4) are arranged. Electronic matching or amplifier circuits (7) with transceivers, tuners or receivers are arranged both on the top and underside of the antenna circuit board (6). Shielding plates (8) which shield the matching or amplifier circuits (7) with transceivers, tuners or receivers from the antenna elements (2, 3, 4) are arranged on the top of the antenna circuit board (6). In addition, there is at least one digital data connection at this multiband antenna.

LIST OF REFERENCE DESIGNATIONS

1 Multiband shark fin antenna
2 Telephone and RKE antenna
3 GPS antenna
4 SDARS antenna
5 Shark-fin-shaped outer cover
6 Antenna circuit board
7 Circuit
8 Shielding plate
9 Bottom part of the antenna housing
10 Antenna housing
11 Protective cover
12 Snap-action hook
13 Snap-action lug
14 Pivoting axis
15 Plug-in connector
16 Plug-in connector
17 Plate of the telephone antenna
18 Foot area of the plate
19 Recess
20 Top of the antenna circuit board
21 Rear of the antenna circuit board
22 Plug contact
23 Locating pin
24 Plug contact
25 Recess
26 Contour
27 Contour

What is claimed is:

1. A multiband shark fin antenna comprising:

a common shark-fin-shaped outer cover defining an interior;

a system arranged in the interior of the shark-fin-shaped outer cover, comprising:

an antenna circuit board having a top side and an underside;

antenna elements including at least one transmitting antenna element and at least one receiving antenna element, the antenna elements being arranged on the top side of the antenna circuit board, a plurality of electronic circuits comprising at least one of matching circuits or amplifier circuits that include at least one of transceivers, tuners, or receivers, wherein at least one of the electronic circuits is arranged on the top side of the antenna circuit board and at least one other of the electronic circuits is arranged on the underside of the antenna circuit board, and at least one shielding plate arranged on the top side of the antenna circuit board and configured to shield the at least one electronic circuit arranged on the top side of the antenna circuit board from the antenna elements arranged on the top side of the circuit board, wherein the antenna circuit board comprises a conductive track extending around one or more electronic devices of the at least one electronic circuit arranged on the top side of the antenna circuit board, the conductive track being connected to ground; and wherein the at least one shielding plate includes a first shielding plate having a plate portion and a perimeter wall extending around a perimeter of the plate portion, wherein the first shielding plate is mounted to the antenna circuit board with the perimeter wall of the first shielding plate mounted to the conductive track, to thereby electrically ground the first shielding plate and to enclose the one or more electronic devices between the first shielding plate and antenna circuit board.

2. The shark fin antenna of claim 1, wherein the transmitting and receiving antenna elements comprise at least one of the following antenna elements:

AM/FM antennas,
telephone and remote keyless entry (RKE) antenna,
GPS antenna,
SDARS antenna,
stacked patch antenna,
DAB antenna,
WLAN antenna,
WIMAX antenna, and
DRM antennas.

3. The shark fin antenna of claim 1, wherein the antenna circuit board, the transmitting and receiving antenna elements, and the electronic circuits are arranged on a bottom part of an antenna housing.

4. The shark fin antenna of claim 2, wherein a protective cover, of the antenna housing, which forms a sheath for the antenna elements, is arranged between the antenna elements and the shark-fin-shaped outer cover.

5. The shark fin antenna of claim 3, wherein the bottom part engages with openings in the outer surface of the vehicle.

6. The shark fin antenna of claim 4, wherein the protective cover engages with the bottom part via snap-action hooks and snap-action lugs.

7. The shark fin antenna of claim 4, wherein the equipped antenna circuit board is supported by the bottom part and covered by the protective cover.

8. The shark fin antenna of claim 4, wherein the protective cover has a pivoting axis to which the shark-fin-shaped outer cover is pivotably attached.

9. The shark fin antenna of claim 1, wherein plug-in connectors protrude out of the bottom part and into the vehicle and are connected to communication devices of the vehicle via feed lines of a cable tree.

10. The shark fin antenna of claim 2, wherein the antenna elements comprise a telephone and remote keyless entry (RKE) antenna, wherein the telephone and RKE antenna has a blade protruding into the shark-fin-shaped outer cover, wherein the blade stands vertically on the antenna circuit board and has a recess in a bottom portion of the blade in which a GPS antenna is arranged as a patch antenna.

11. The shark fin antenna of claim 2, wherein a GPS patch antenna is arranged on a shielding plate which encloses at least one of an amplifier and an antenna matching circuit.

12. The shark fin antenna of claim 2, wherein an SDARS antenna is arranged as a patch antenna spaced apart from the GPS patch antenna on a shielding plate on the antenna circuit board, the shielding plate enclosing at least one of an amplifier and an antenna matching circuit.

* * * * *